US006812945B2

(12) United States Patent
Gao et al.

(10) Patent No.: US 6,812,945 B2
(45) Date of Patent: Nov. 2, 2004

(54) PREVENTING CREASE FORMATION IN DONOR WEB IN DYE TRANSFER PRINTER THAT CAN CAUSE LINE ARTIFACT ON PRINT

(75) Inventors: Zhanjun J. Gao, Rochester, NY (US); Po-Jen Shih, Webster, NY (US); Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/394,888

(22) Filed: Mar. 21, 2003

(65) Prior Publication Data

US 2004/0183889 A1 Sep. 23, 2004

(51) Int. Cl.[7] ..... B41J 35/08

(52) U.S. Cl. ..... 347/216; 400/234

(58) Field of Search ..... 347/216, 220; 400/648, 659, 234, 247, 248

(56) References Cited

FOREIGN PATENT DOCUMENTS

| | | | | |
|---|---|---|---|---|
| JP | 59-068282 | * | 4/1984 | ..... B41J/17/30 |
| JP | 56-28880 | * | 3/1985 | ..... 400/234 |
| JP | 60-157889 | * | 8/1985 | ..... 400/234 |
| JP | 8-230262 | * | 9/1996 | ..... B41J/17/30 |

* cited by examiner

*Primary Examiner*—Huan Tran
(74) *Attorney, Agent, or Firm*—Roger A. Fields; Mark G. Bocchetti

(57) ABSTRACT

A thermal printer is adapted to prevent crease formation in a dye transfer area of a dye donor web that can cause line artifacts to be printed on a dye receiver during a dye transfer from the dye transfer area to the dye receiver in a dye transfer printer.

15 Claims, 14 Drawing Sheets

1

PREVENTING CREASE FORMATION IN DONOR WEB IN DYE TRANSFER PRINTER THAT CAN CAUSE LINE ARTIFACT ON PRINT

CROSS-REFERENCE TO RELATED APPLICATION

Cross-reference is made to commonly assigned, co-pending application Ser. No. 10/392,502 entitled PREVENTING CREASE FORMATION IN DONOR WEB IN DYE TRANSFER PRINTER THAT CAN CAUSE LINE ARTIFACT ON PRINT, and filed Mar. 20, 2003 in the names of Zhanjun J. Gao, John F. Corman and Robert F. Mindler.

FIELD OF THE INVENTION

The invention relates generally to dye transfer printers such as thermal printers, and in particular to the problem of crease or wrinkle formation in successive dye transfer areas of a dye donor web. Crease formation in the dye transfer area can result in an undesirable line artifact being printed on a dye receiver.

BACKGROUND OF THE INVENTION

A typical multi-color dye donor web that is used in a thermal printer is substantially thin and has a repeating series of three different rectangular-shaped color sections or patches such as a yellow color section, a magenta color section and a cyan color section. Also, there may be a transparent colorless laminating section immediately after the cyan color section.

Each color section of the dye donor web consists of a dye transfer area that is used for dye transfer printing and a pair of opposite longitudinal edge areas alongside the dye transfer area which are not used for printing. The dye transfer area is about 95% of the web width and the two edge areas are each about 2.5% of the web width.

To make a multi-color image print using a thermal printer, a motorized donor take-up spool pulls the dye donor web from a donor supply spool in order to successively draw an unused single series of yellow, magenta and cyan color sections over a stationary bead of selectively heated resistive elements on a thermal print head between the two spools. Respective color dyes within the yellow, magenta and cyan color sections are successively heat-transferred, via the bead of selectively heated resistive elements, in superimposed relation onto a dye receiver such as a paper or transparency sheet or roll, to form the color image print. The bead of resistive elements extends across the entire width of a color section, i.e. across its dye transfer area and the two edge areas alongside the transfer area. However, only those resistive elements that contact the dye transfer area are selectively heated. Those resistive elements that contact the two edge areas are not heated. In other words, the dye transfer is effected from the dye transfer area to the receiver medium, but not from the two edge areas to the receiver medium.

As each color section, including its dye transfer area and the two edge areas alongside the transfer area, is drawn over the bead of selectively heated resistive elements, the color section is subjected to a longitudinal tension particularly by a pulling force of the motorized donor take-up spool. Since the dye transfer area is heated by the resistive elements, but the two edge areas alongside the transfer area are not, the transfer area is significantly weakened and vulnerable to stretching as compared to the two edge areas. Consequently, the longitudinal tension will stretch the dye transfer area relative to the two edge areas. This stretching causes the dye transfer area to become thinner than the non-stretched edge areas, which in turn causes creases or wrinkles to develop in the transfer area, particularly diagonally across those regions of the transfer area that are close to the two edge areas. The creases or wrinkles are most notable in the regions of the dye transfer area that are close to the two edge areas because of the sharp, i.e. abrupt, transition between the weakened transfer area and the stronger edge areas, and they tend to be slanted diagonally across such regions.

As the dye donor web is pulled by the motorized donor take-up spool over the bead of selectively heated resistive elements, the creases or wrinkles tend to spread from a trailing or rear end portion of a used dye transfer area at least to a leading or front end portion of the next dye transfer area to be used. A problem that can result is that creases or wrinkles in the leading or front end portion of the next dye transfer area to be used will cause undesirable line artifacts to be printed on a leading or front end portion of the dye receiver, when the dye transfer occurs at the creases in the leading end portion of the next dye transfer area to be used. The line artifacts printed on the dye receiver are relatively short, but quite visible.

The question presented therefore is how to solve the problem of the creases or wrinkles being created in an unused transfer area so that no line artifacts are printed on the dye receiver during the dye transfer.

The Cross-Referenced Application

The cross-referenced application discloses a thermal printer capable of preventing crease formation in a dye transfer area of a dye donor web that can cause line artifacts to be printed on a dye receiver during a dye transfer from the dye transfer area to the dye receiver in a dye transfer printer. The printer comprises:

- a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver so that the dye transfer area is vulnerable to being stretched relative to the two edge areas;
- a web take-up that takes up the dye donor web, and that exerts a pulling force on the dye transfer area and two edge areas at the print head which is sufficient to stretch the dye transfer area relative to the two edge areas to possibly form slanted creases diagonally extending at least across respective regions adjacent the two edge areas; and
- a web spreader adapted to spread the dye donor web diagonally across at least the regions in which slanted creases can form in order to oppose crease formation that can occur when the pulling force is exerted, whereby crease formation can at least be substantially prevented.

SUMMARY OF THE INVENTION

According to one aspect of the invention, there is provided a thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a web take-up that takes up the dye donor web, and that exerts a pulling force on the dye transfer area and two edge areas at the print head which is sufficient to stretch the dye transfer area relative to the two edge areas to possibly form slanted creases diagonally extending at least across respective regions adjacent the two edge areas; and a crease preventing roller having respective web spreading portions that are similarly coiled inwardly along said roller from opposite coaxial ends of said roller, to be coiled towards one another from said opposite ends, in order to diagonally spread at least the web regions in which slanted creases can form, in opposition to crease formation that can occur when the pulling force is exerted on the dye transfer area and two edge areas at the print head, whereby crease formation can at least be substantially prevented.

According to another aspect of the invention, there is provided a method of preventing crease formation in a dye transfer area of a dye donor web that can cause line artifacts to be printed on a dye receiver during a dye transfer from the dye transfer area to the dye receiver in a dye transfer printer. The method corresponds to operation of the printer as described above.

DETAILED DESCRIPTION OF THE INVENTION

Donor Web

Figure 1:
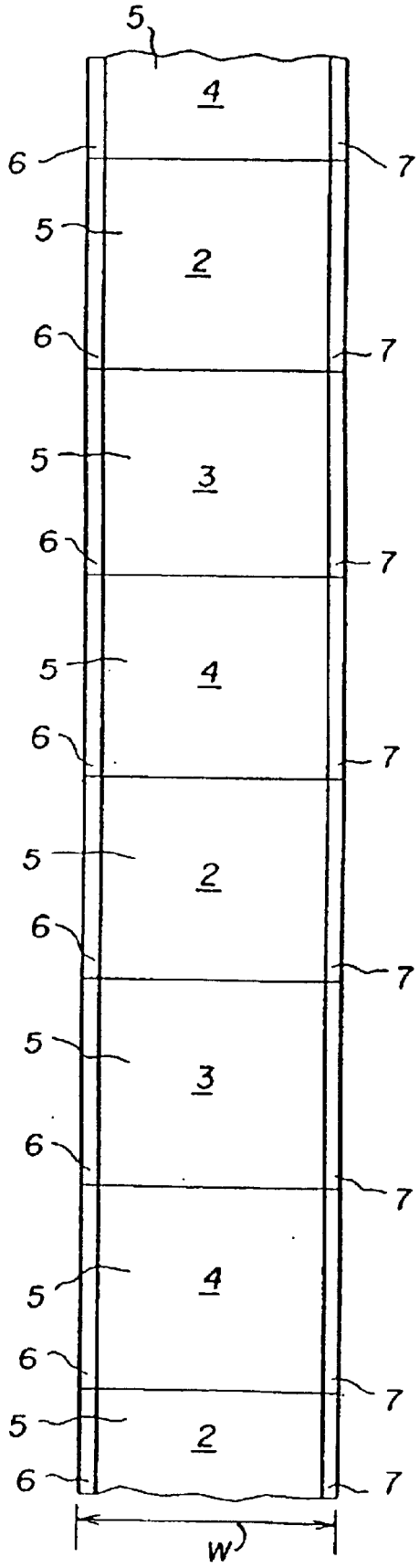
FIG. 1 is plan view of a typical dye donor web including successive dye transfer areas and opposite longitudinal edge areas alongside each one of the dye transfer areas.

FIG. 1 depicts a typical multi-color dye donor web or ink ribbon 1 that is used in a thermal printer. The dye donor web 1 is substantially thin and has a repeating series (only two completely shown) of three different rectangular-shaped color sections or patches such as a yellow color section 2, a magenta color section 3 and a cyan color section 4. Also, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 that is used for printing and a pair of similar-colored opposite longitudinal edge areas 6 and 7 alongside the dye transfer area which are not used for printing. The dye transfer area 5 is about 95% of the web width W and the two edge areas 6 and 7 are each about 2.5% of the web width. See FIG. 1.

Dye Transfer Printer

FIGS. 2–6 depict operation of a thermal printer 10 using the dye donor web 1 to effect successive yellow, magenta and cyan dye transfers in superimposed relation onto a known dye receiver sheet 12 such as paper or a transparency.

Initialization

Figure 2:
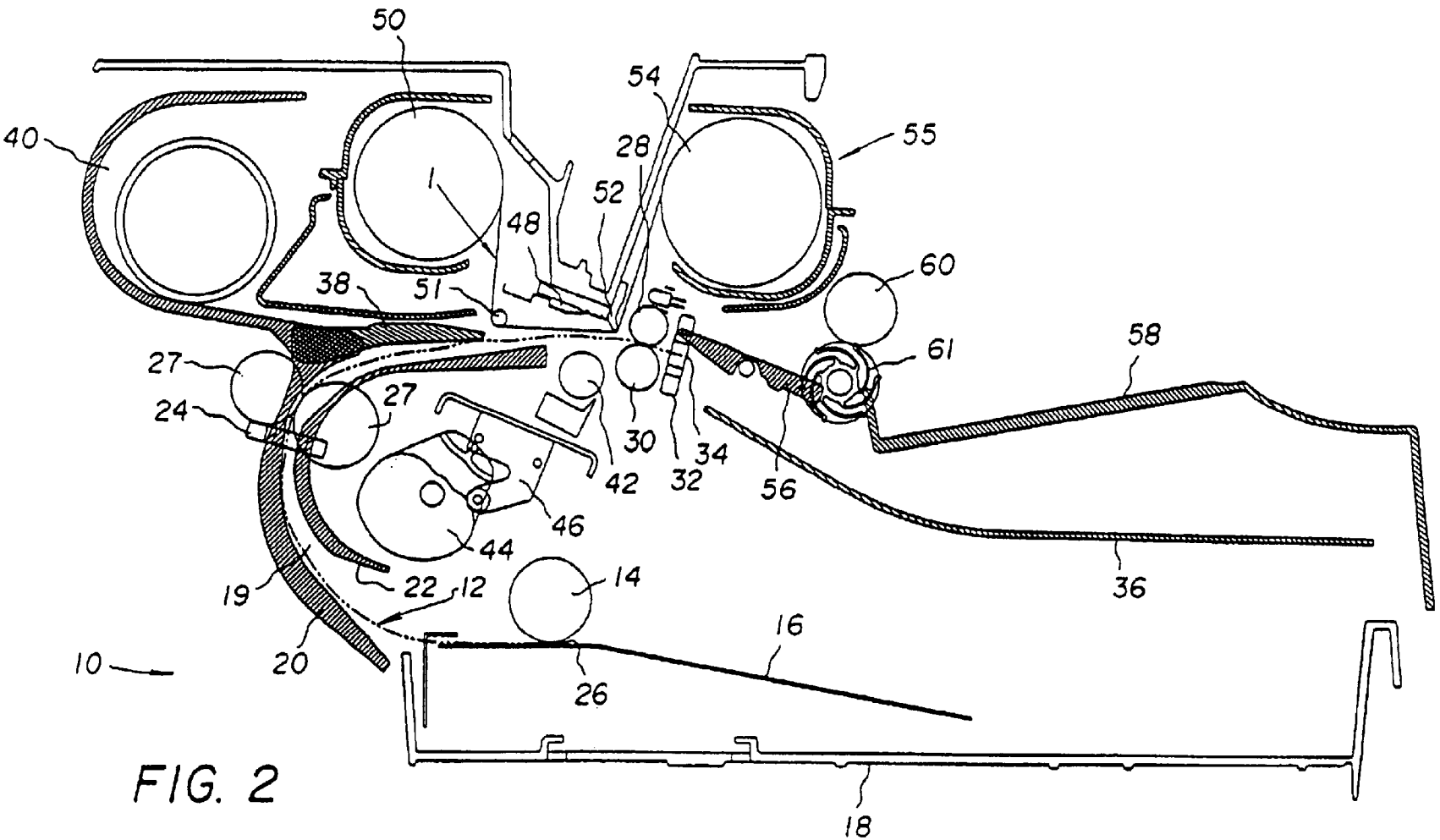
FIG. 2 is an elevation section view, partly in section, of a dye transfer printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of motorized parallel-axis urge rollers 27, 27 in the channel 19. The activated rollers 27, 27 advance the receiver sheet 12 forward (to the right in FIG. 2) through the nip of a motorized capstan roller 28 and a pinch roller 30, positioned beyond the channel 19, and to a leading (front) edge sensor 32.

Figure 3:
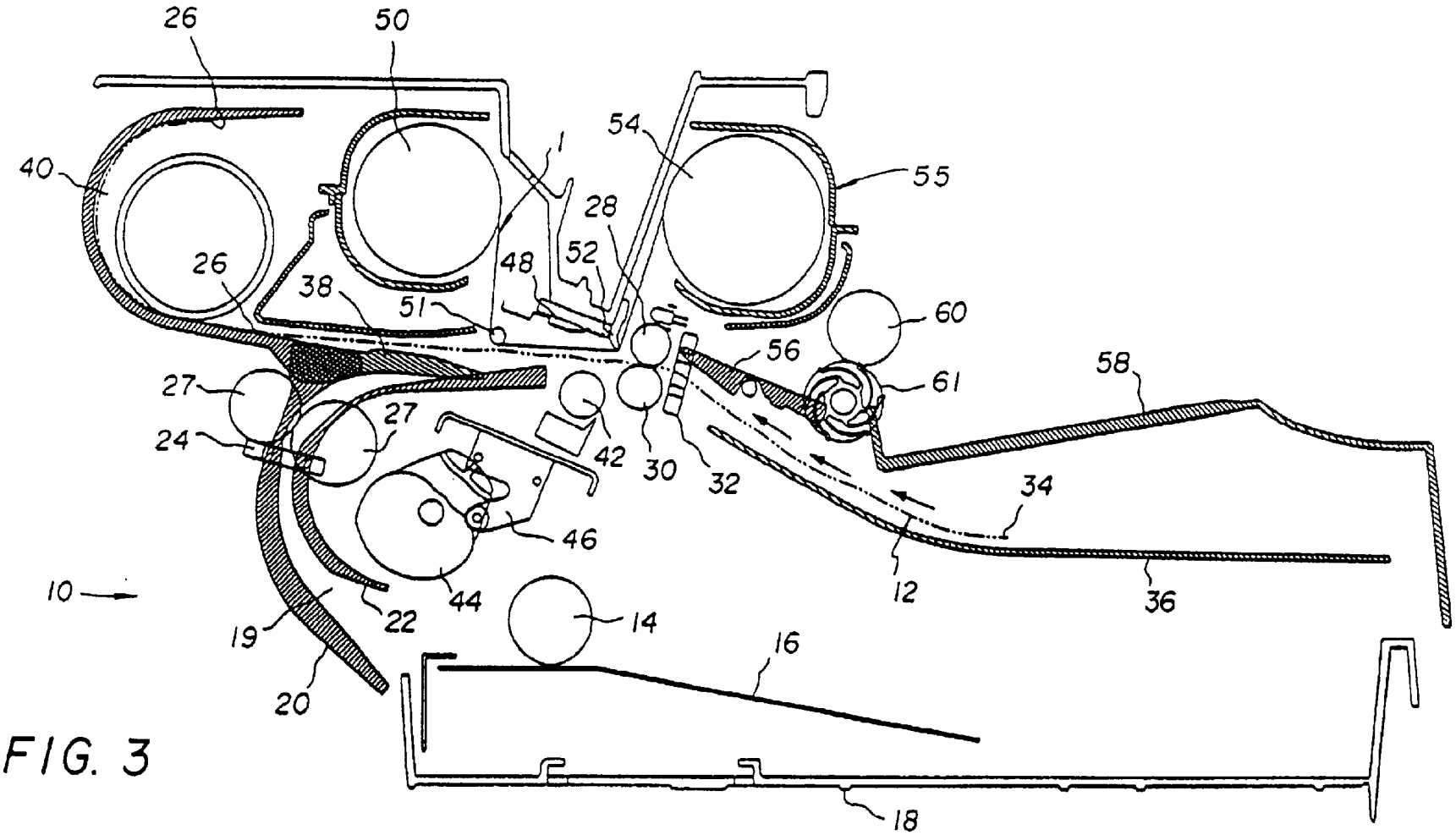
FIGS. 3 and 4 are elevation section views of the dye transfer printer as in FIG. 2, showing successive dye transfer cycles during the printer operation.

In FIG. 3, the leading edge sensor 32 has sensed a leading or front edge 34 of the dye receiver sheet 12 and activated the motorized capstan roller 28 to cause that roller and the pinch roller 30 to advance the receiver sheet forward partially onto an intermediate tray 36. The receiver sheet 12 is advanced forward onto the intermediate tray 36 so that the trailing or rear edge 26 of-the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the dye donor web 1 must be successively heat-transferred in superimposed relation onto the dye receiver sheet 12. This is shown beginning in FIG. 4.

Figure 4:
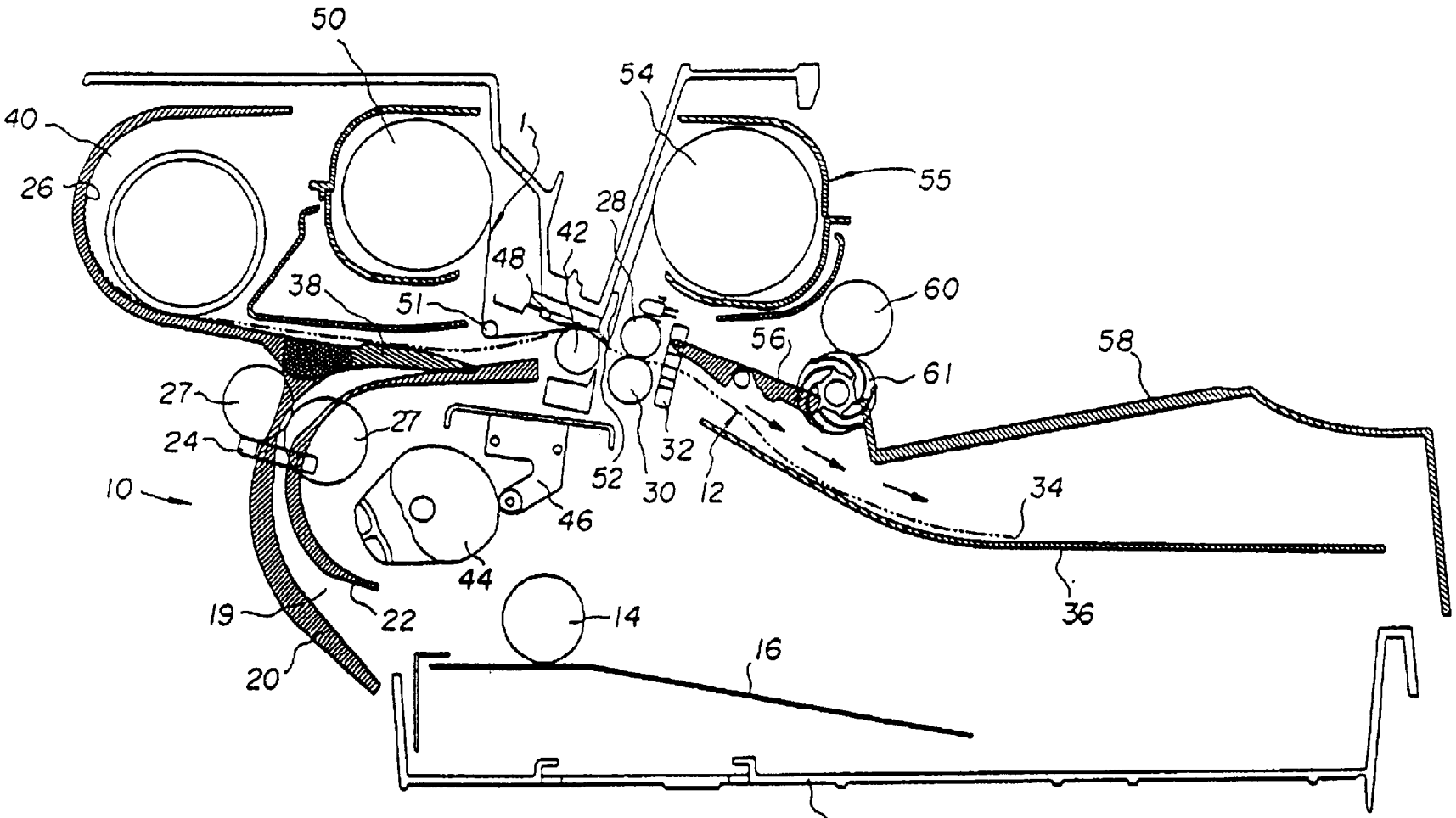

In FIG. 4, a platen roller 42 is shifted via a rotated cam 44 and a platen lift 46 to adjacent a thermal print head 48. This causes the dye receiver sheet 12 and an unused (fresh) yellow color section 2 of the dye donor web 1 to be locally held together between the platen roller 42 and the print head 48. The motorized capstan roller 28 and the pinch roller 30 are reversed to again advance the dye receiver sheet 12 forward to begin to return the receiver sheet to the intermediate tray 36. At the same time, the dye donor web 1 is moved forward from a donor web supply spool 50, over a stationary donor web guide bar 51, the print head 48, and a stationary donor web guide nose 52. This is accomplished by a motorized donor web take-up spool 54 that incrementally (progressively) pulls or draws the dye donor web forward. The donor web supply and take-up spools 50 and 54 together with the dye donor web 1 may be provided in a replaceable cartridge 55 that is manually loaded into the printer 10.

Figure 7:
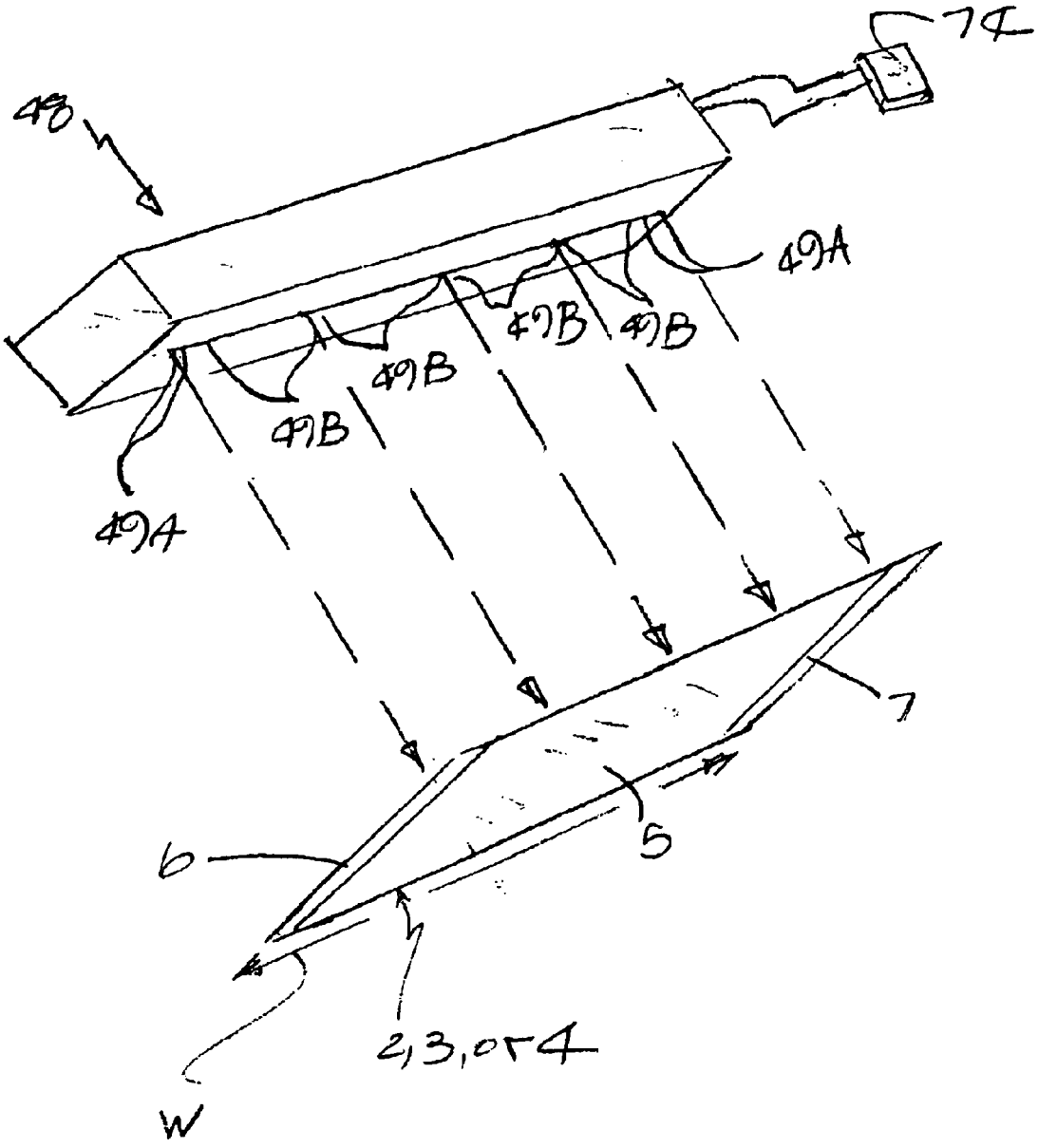
FIG. 7 is a perspective view of a bead of selectively heated resistive elements on a print head in the dye transfer printer.

When the yellow color section 2 of the dye donor web 1 is pulled forward over the print head 48 in FIG. 4, the yellow color dye in the dye transfer area 5 of that color section is heat-transferred onto the dye receiver sheet 12. The yellow color dye in the two edge areas 6 and 7 of the yellow color section 2, which are alongside the dye transfer area 5, is not heat-transferred onto the dye receiver sheet 12. In this connection, the print head 48 has a bead of selectively heated, closely spaced, resistive elements 49A, 49A, . . . , 49B, 49B, . . . , 49A, 49A, . . . , on the print head 48 that make contact across the entire width W of the yellow color section 2, i.e. across its dye transfer area 5 and the two edge areas 6 and 7 alongside the transfer area. As shown in FIG. 7, the resistive elements 49A make contact with the edge areas 6 and 7 and the resistive elements 49B make contact with the dye transfer area 5. However, only the resistive elements 49B are selectively heated sufficiently to effect the yellow dye transfer from the dye transfer area 5 to the dye receiver sheet 12. The yellow dye transfer is done line-by-line, i.e. row-by-row, widthwise across the dye transfer area 5. The resistive elements 49A are not heated (or only slightly heated) so that there is no yellow dye transfer from the edge areas 6 and 7 to the dye receiver sheet 12.

Figure 5:
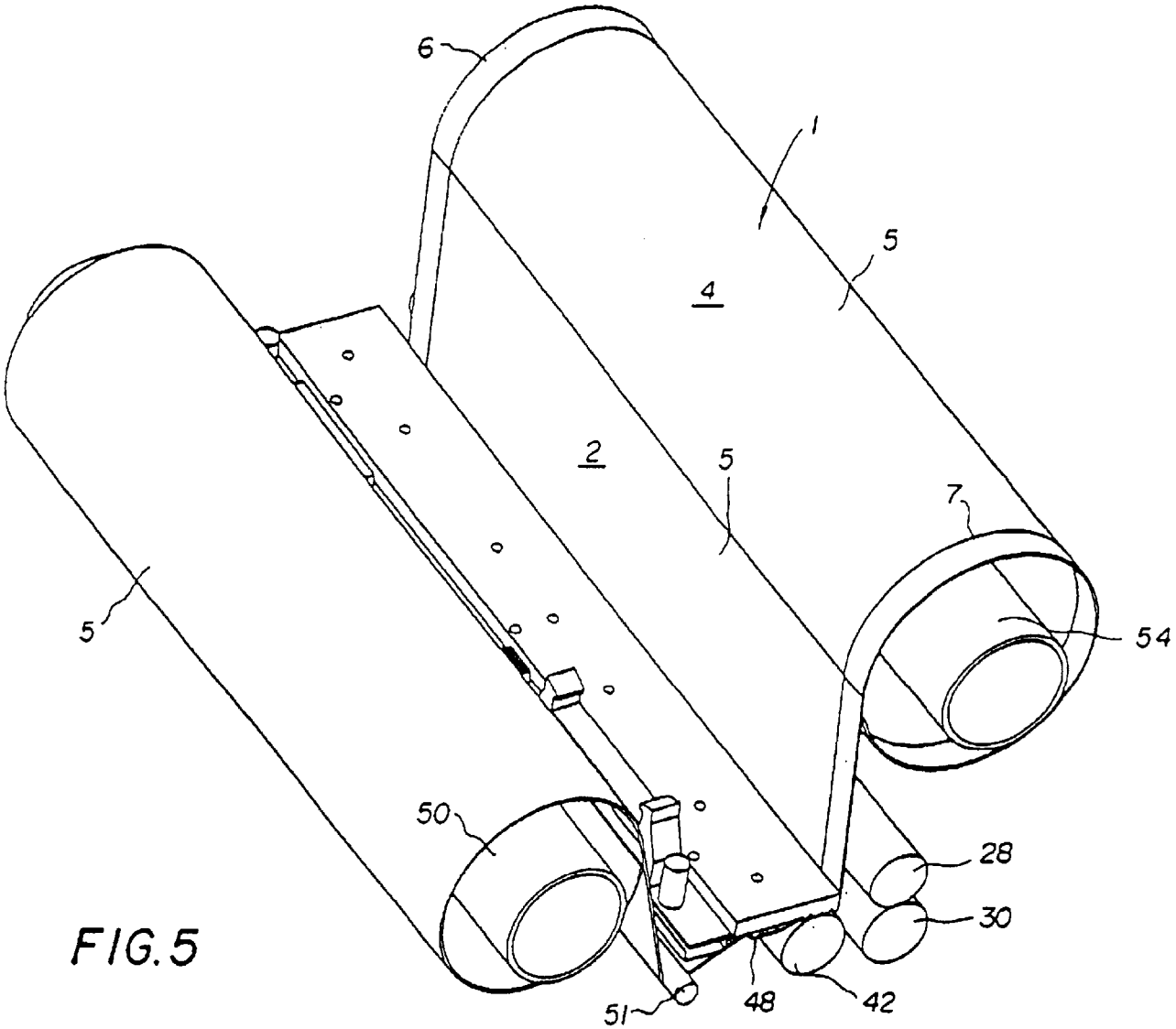
FIG. 5 is perspective view of a printing or dye transfer station in the dye transfer printer.

As the yellow color section 2 of the dye donor web 1 is used for dye transfer line-by-line, it is pulled forward from the print head 48 and over the guide nose 52 in FIGS. 4 and 5. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet 12 rearward, i.e. trailing or rear edge 26 first, partially into the rewind chamber 40. See FIG. 3.

Then, the dye transfer onto the dye receiver sheet 12 is repeated line-by-line in FIG. 4, but this time using an unused (fresh) magenta color section 3 of the dye donor web 1 to heat-transfer the magenta color dye from the dye transfer area 5 of that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing or rear edge 26 first, partially into the rewind chamber 40. See FIG. 3.

Then, the dye transfer onto the dye receiver sheet 12 is repeated line-by-line in FIG. 4, but this time using an unused (fresh) cyan color section 3 of the dye donor web 1 to heat-transfer the cyan color dye from the dye transfer area 5 of that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing or rear edge 26 first, partially into the rewind chamber 40. See FIG. 3.

Final

Figure 6:
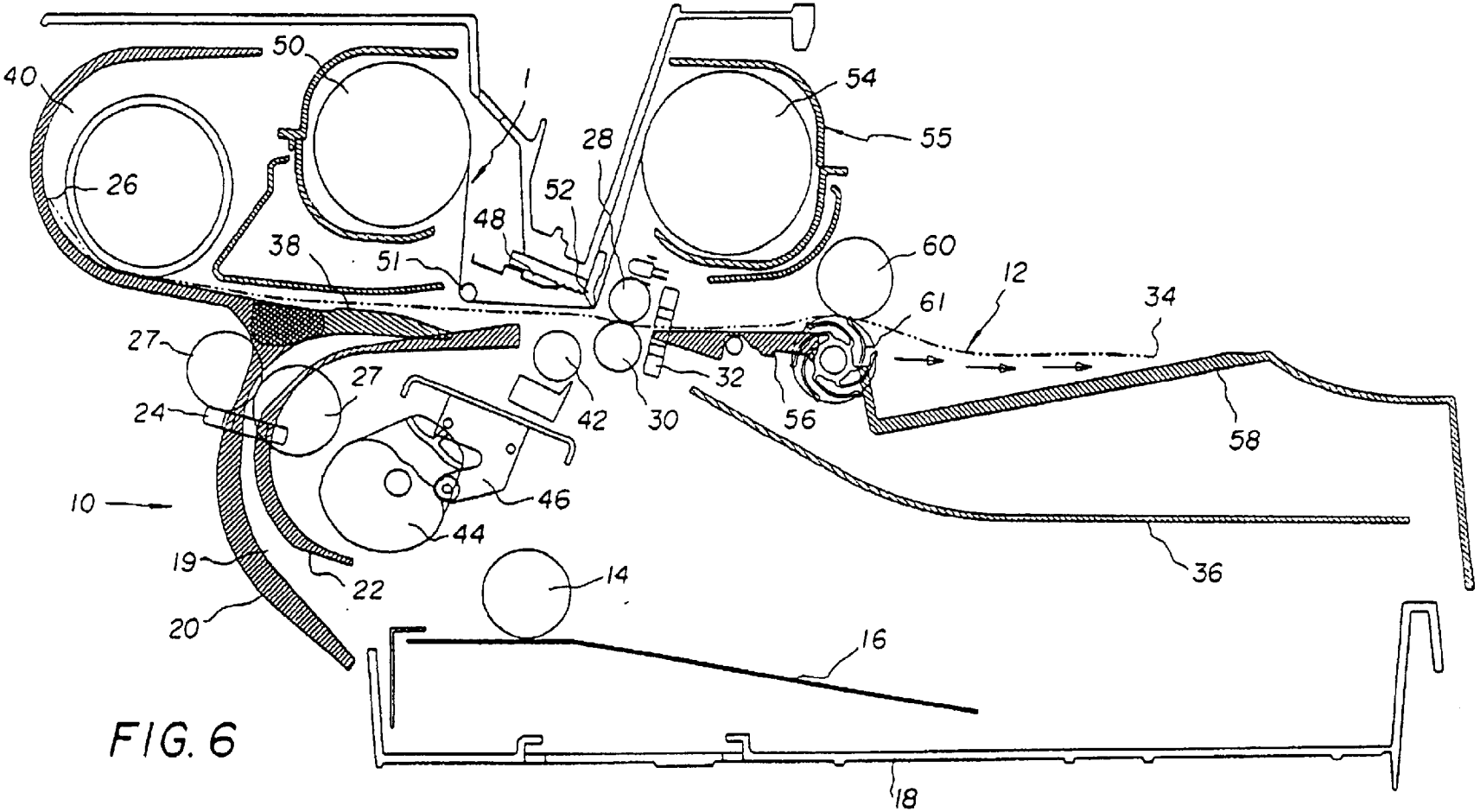
FIG. 6 is an elevation section view of the dye transfer printer as in FIG. 2, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 61 aid in advancing the receiver sheet 12 into the exit tray 58.

Prior Art Problem

Figure 8:
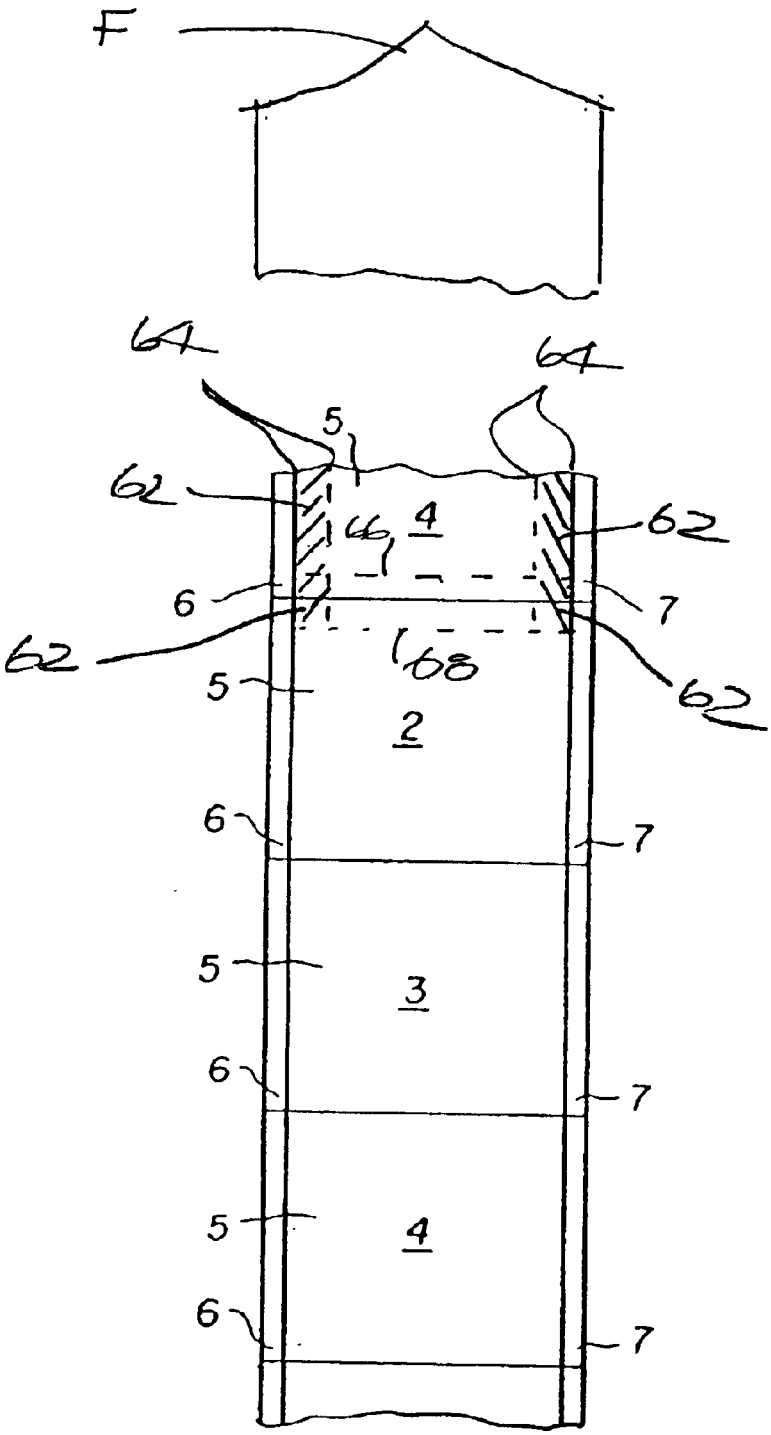
FIG. 8 (Prior Art)
FIG. 8 is a plan view of a portion of the donor web as in FIG. 1, showing slanted creases or wrinkles spreading rearward from a trailing or rear end portion of a used transfer area into a leading or front end portion of an unused transfer area in the next (fresh) color section to be used, as in the prior art.

Typically in prior art dye transfer, as each yellow, magenta and cyan color section 2, 3 and 4, including its dye transfer area 5 and the two edge areas 6 and 7 alongside the transfer area, is pulled or drawn forward over the bead of selectively heated resistive elements 49A, 49A, . . . , 49B, 49B, . . . , 49A, 49A, . . . , the color section is subjected to a longitudinal tension imposed substantially by a uniform or substantially uniform pulling force F of the motorized donor web take-up spool 54. See FIG. 8. Moreover, since the dye transfer area 5 is heated by the resistive elements 49B, but the two edge areas 6 and 7 alongside the transfer area are not heated by the resistive elements 49A, the dye transfer area is significantly weakened in relation to the two edge areas and therefore becomes more susceptible or vulnerable to being stretched than the edge areas. See FIG. 7. Consequently, the longitudinal tension imposed by the pulling force F of the motorized take-up spool 54 will stretch the dye transfer area 5 relative to the two edge areas 6 and 7. This stretching causes the dye transfer area 5 to become thinner than the non-stretched edge areas 6 and 7, which in turn causes slanted creases or wrinkles 62 to develop in the dye transfer area, particularly across those regions 64 of the transfer area that are close to the two edge areas. See FIGS. 8 and 12. The slanted creases or wrinkles 62 are most notable in the regions 64 of the dye transfer area 5 that are close to the two edge areas 6 and 7 because of the sharp, i.e. abrupt, transition between the weakened transfer area and the stronger edge areas, and they are inclined at an approximately 45° acute angle $\alpha$ from each edge area 6 or 7 as shown in FIGS. 8. and 12 to diagonally extend forward at least within each region 64.

Figure 9:
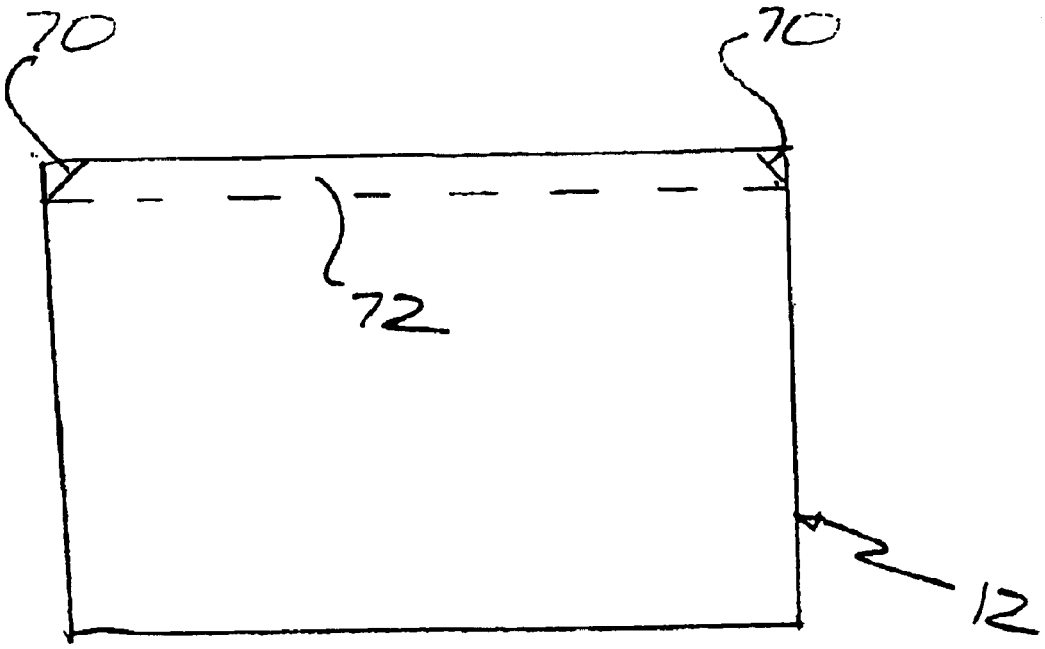
FIG. 9 (Prior Art)
FIG. 9 is a plan view of a dye receiver sheet, showing line artifacts printed on a leading or front edge portion of the dye receiver sheet, as in the prior art.

As the dye donor web 1 is pulled by the motorized donor take-up spool 54 over the bead of selectively heated resistive elements 49A, 49A, . . . , 49B, 49B, . . . , 49A, 49A, . . . , the slanted creases or wrinkles 62 tend to spread rearward from a trailing or rear end portion 66 of a used dye transfer area 5 at least to a leading or front end portion 68 of the next dye transfer area to be used. See FIG. 8. A problem that can result is that slanted creases or wrinkles 62 in the leading or front end portion 68 of the next dye transfer area 5 to be used will cause undesirable line artifacts 70 to be printed on a leading or front end portion 72 of the dye receiver sheet 12, when the dye transfer occurs at the creases in the leading end portion of the next transfer area to be used. See FIG. 9. The line artifacts 70 printed on the dye receiver sheet 12 are relatively short, but quite visible.

The question presented therefore is how to solve the problem of the slanted creases or wrinkles 62 being created in an unused transfer area 5 so that no line artifacts 70 are printed on the dye receiver sheet 12 during the dye transfer.

Solution (FIGS. 10–13)

As previously mentioned, during successive yellow, magenta and cyan dye transfers onto the dye receiver sheet 12 in the thermal printer 10, the resistive elements 49B make contact across the dye transfer area 5 and the resistive elements 49A make contact across the two edge areas 6 and 7 alongside the dye transfer area. See FIG. 7. However, only the resistive elements 49B are selectively heated sufficiently to effect the dye transfers. Thus, the dye transfer area 5 becomes more susceptible or vulnerable to being stretched than the two edge areas 5 and 6 alongside the dye transfer area.

A known heat activating control 74, preferably including a suitably programmed microcomputer using known programming techniques, is connected individually to the resistive elements 49A, 49A, . . . , 49B, 49B, . . . , 49A, 49A, . . . , to selectively heat those resistive elements 49B that make contact with the dye transfer area 5, and preferably not heat those resistive elements 49A that make contact with the two edge areas 6 and 7 alongside the dye transfer area. See FIG. 7.

The platen roller 42 in the printer 10, shown in FIGS. 2–6, is cylindrical in shape and therefore has a constant diameter. As such, it is substantially ineffective to prevent the slanted creases 62 from forming in the regions 64 of the dye transfer area 5 that are close to the two edge areas 6 and 7. See FIG. 8.

Preferred Embodiment

Figure 10:
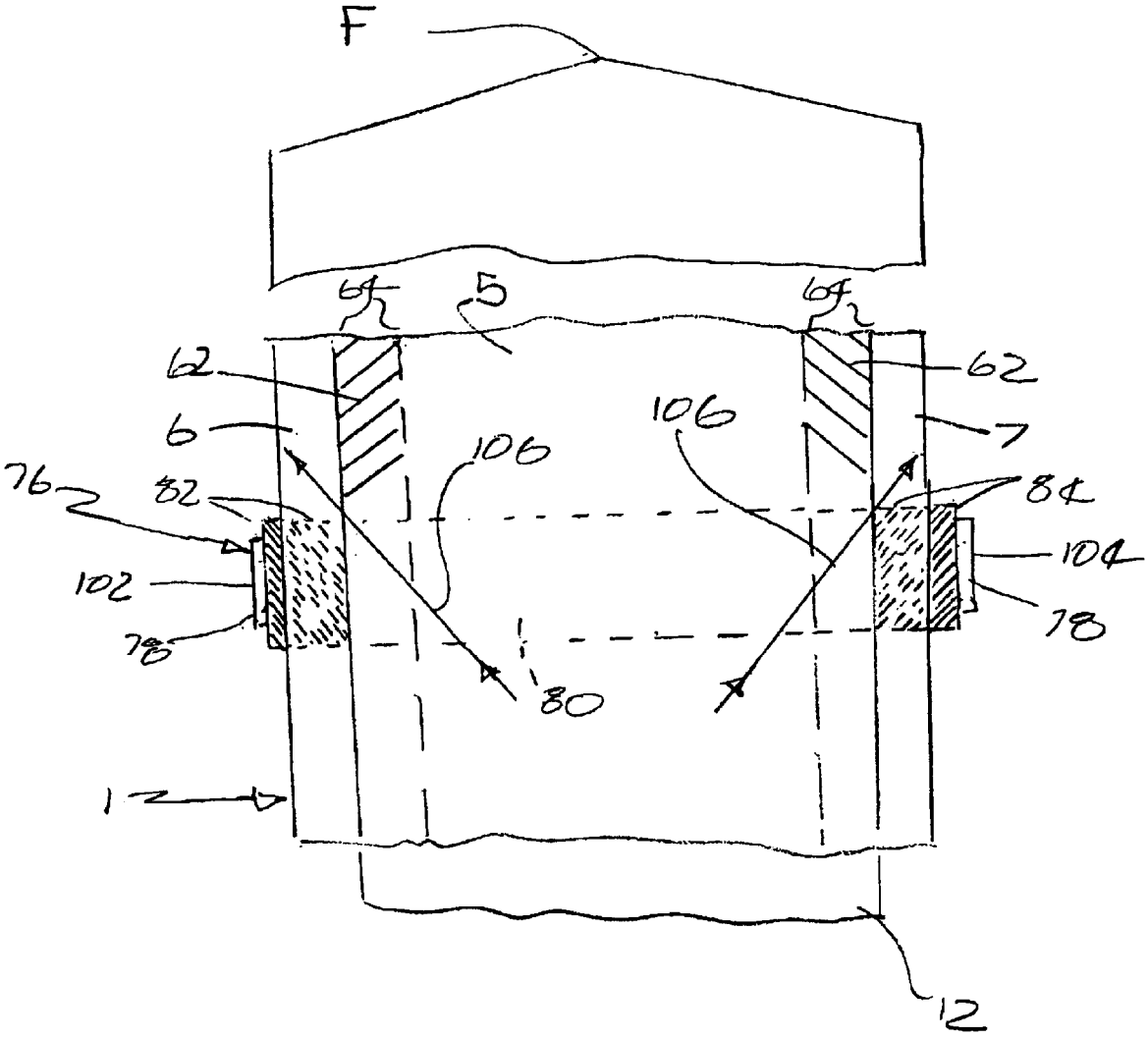
FIG. 10 is a plan view of the dye donor web and of a platen roller having web spreading portions according to a preferred embodiment of the invention.
Figure 11:
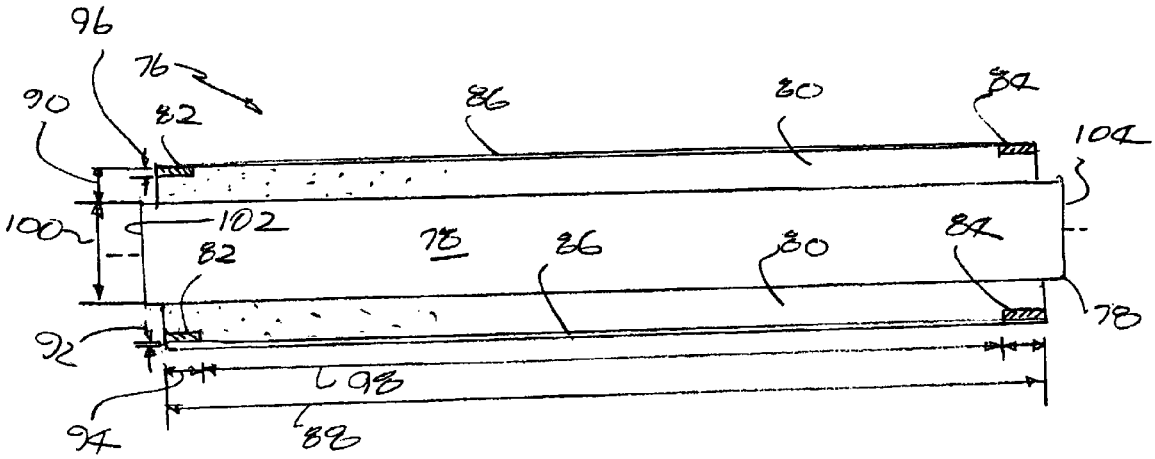
FIG. 11 is a cross-section view of the platen roller including its web spreading portions according to the preferred embodiment.

According to a preferred embodiment of the invention, shown in FIGS. 10 and 11, there has been devised a platen roller 76 to be used in place of the platen roller 42 in the printer 10. In contrast to the platen roller 42, the platen roller 76 is a crease preventing roller that prevents the slanted creases 62 from forming in the regions 64 of the dye transfer area 5 that are close to the two edge areas 6 and 7.

The platen/crease preventing roller 76 has a rigid coaxial solid or hollow core 78, an elastic (e.g. rubber) sleeve portion 80 concentrically affixed to the core, a pair of ring-shaped web spreading portions 82 and 84 wholly or partially imbedded in the elastic sleeve portion, and a thin elastomeric peripheral covering 86 over the sleeve portion and the pair of web spreading portions. See FIG. 11. In one example, the width 88 of the sleeve portion 80 and of the peripheral covering 86 is the same, 165 mm (which is 2 mm greater than the width W of the dye donor web 1), the thickness 90 of the sleeve portion 80 is 5 mm, the thickness 92 of the peripheral covering 86 is 0.13 mm, the width 94 of each web spreading portion 82 and 84 is 6.5 mm (which is slightly greater than the width of the two edge areas 6 and 7 alongside the dye transfer area 5 on the dye donor web 1) and their thickness 96 is 2 mm, the distance 98 along the sleeve portion 80 between the web spreading portions 82 and 84 is 152 mm (which is the width of the dye transfer area 5 and of the dye receiver 12), and the diameter 100 of the core 78 is 8 mm.

The platen/crease preventing roller 76 operates as a crease preventing roller because the web spreading portions 82 and 84 are similarly coiled diagonally about the core 78 and inwardly from opposite coaxial ends 102 and 104 of the roller, to be coiled towards one another from the opposite ends. Moreover, they are coiled at an inclination of 45°+/−30°, i.e. between 15° and 75°, but preferably 45°. The diagonal coiling enables the web spreading portions 82 and 84 to diagonally urge the two edge areas in order to diagonally spread the dye transfer area 5, including the web regions 64 in which the slanted creases 62 can form, to oppose or counteract crease formation that can occur when the pulling force F is exerted on the dye transfer area at the print head 48. Preferably, the opposition is perpendicular to the tendency of crease formation.

Figure 12:
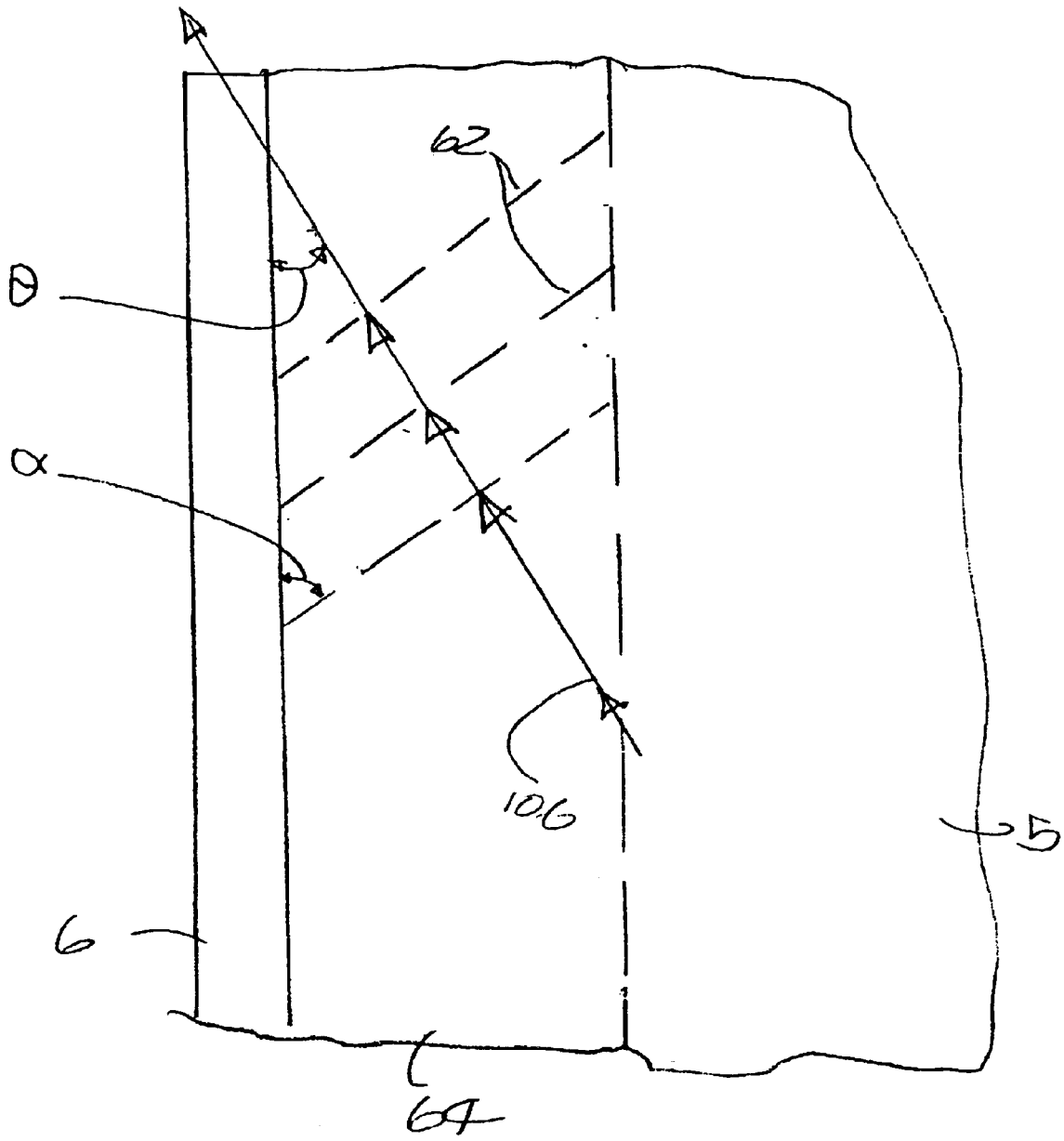
FIG. 12 is a schematic view depicting operation of one of the web spreading portions.

As shown in FIGS. 10 and 12, the web spreading portions 82 and 84 diagonally urge the two edge areas 6 and 7 to spread the dye transfer area 5, including the web regions 64, in respective spreading directions 106, 106 diagonally across at least such regions. The web spreading directions 106, 106, as shown, perpendicularly oppose or counteract the tendency of crease formation in the regions 64. Thus, they are depicted inclined at a 45° acute angle θ from each edge area 6 or 7 and diagonally extending forward at least within each region 64. See FIG. 12. However, the acute angle θ can be varied 45°+/−30°, i.e. between 15° and 75°.

The web spreading portions 82 and 84 can be any suitable means that are similarly coiled diagonally inwardly about the core 78 from the opposite ends 102 and 104 of the platen roller 76, to be coiled towards one another from the opposite ends. For example, the web spreading portions 82 and 84 can be suitable fibers 82 and 84 diagonally wound inwardly at a 45° inclination about the core 78 from the opposite ends 102 and 104 as in FIG. 11. Alternatively, they can be a 45° helical screw-like thread, etc.

First Alternate Embodiment

The stationary donor web guide bar 51 in the printer 10, shown in FIGS. 2–6, is cylindrical in shape and therefore has a constant diameter. As such, it is substantially ineffective to prevent the slanted creases 62 from forming in the regions 64 of the dye transfer area 5 that are close to the two edge areas 6 and 7. See FIG. 8.

Figure 13:
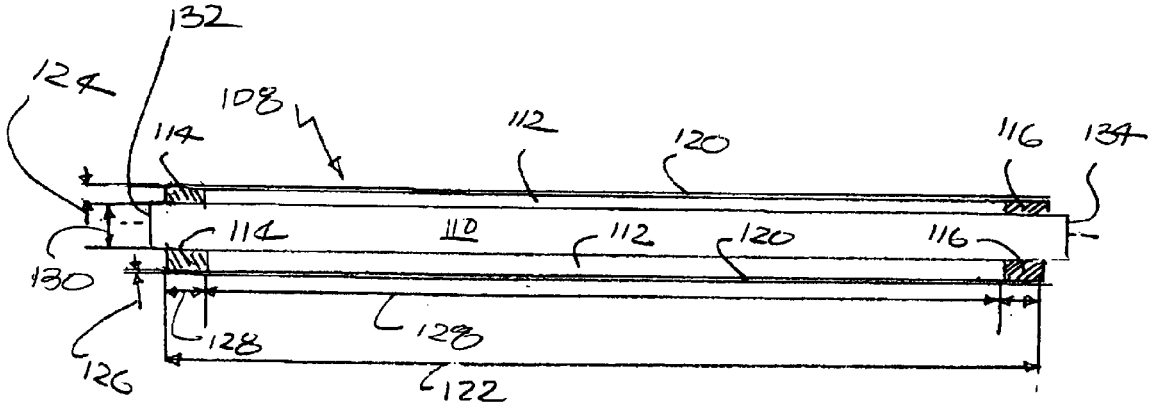
FIG. 13 is a cross-section view of a web spreading roller according to a first alternate embodiment of the invention.

According to a first alternate embodiment of the invention, shown in FIG. 13, there has been devised a donor web guide/crease preventing roller 108 to be used in place of the donor web guide bar 51 in the printer 10. In contrast to the donor web guide bar 51, the donor web guide/crease preventing roller 108 prevents the slanted creases 62 from forming in the regions 64 of the dye transfer area 5 that are close to the two edge areas 6 and 7, much like the way the platen/crease preventing roller 76 does the sane.

The donor web guide/crease preventing roller 108 has a rigid coaxial solid or hollow core 110, an elastic (e.g. rubber) sleeve portion 112 concentrically affixed to the core, a pair of ring-shaped web spreading portions 114 and 116 concentrically affixed to the core, and a thin elastomeric peripheral covering 120 over the sleeve portion and the pair of web spreading portions. See FIG. 13. In one example, the width 122 of the peripheral covering 86 and of the combination of the sleeve portion 112 and the web spreading portions 114 and 116 is the same, 165 mm (which is 2 mm greater than the width W of the dye donor web 1), the thickness 124 of the sleeve portion 112 and of the web spreading portions 114 and 116 is the same, 1.62 mm, the thickness 126 of the peripheral covering 86 is 0.13 mm, the width 128 of each web spreading portion 114 and 116 is 6.5 mm (which is slightly greater than the width of the two edge areas 6 and 7 alongside the dye transfer area 5 on the dye donor web 1), the distance 128 along the sleeve portion 112 between the web spreading portions 114 and 116 is 152 mm (which is the width of the dye transfer area 5 and of the dye receiver 12), and the diameter 130 of the core 110 is 9.5 mm.

The donor web guide/crease preventing roller platen roller 108 operates as a crease preventing roller because the web spreading portions 114 and 116 are similarly coiled diagonally about the core 110 and inwardly from opposite coaxial ends 132 and 134 of the roller, to be coiled towards one another from the opposite ends.

Second Alternate Embodiment

The stationary donor web guide nose 52 in the printer 10, shown in FIGS. 2–6, has a shape that is substantially ineffective to prevent the slanted creases 62 from forming in the regions 64 of the dye transfer area 5 that are close to the two edge areas 6 and 7. See FIG. 8.

Figure 14:
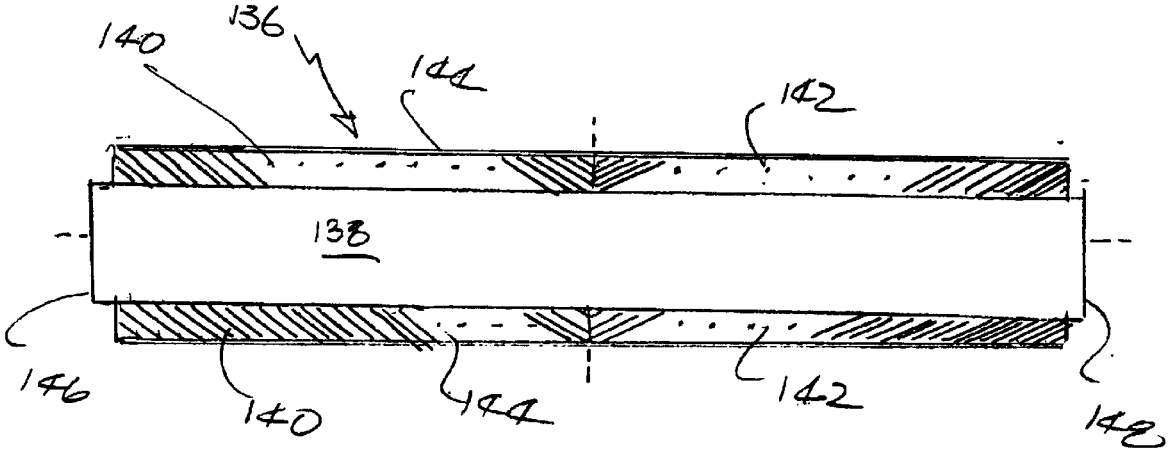
FIG. 14 is a cross-section view of a web spreading roller according to a second alternate embodiment of the invention.

According to a second alternate embodiment of the invention, shown in FIG. 14, there has been devised a donor web guide/crease preventing roller 136 to be used in place of the donor web guide nose 52 in the printer 10. In contrast to the donor web guide nose 52, the donor web guide/crease preventing roller 136 prevents the slanted creases 62 from forming in the regions 64 of the dye transfer area 5 that are close to the two edge areas 6 and 7, much like the way the platen/crease preventing roller 76 does the same.

The donor web guide/crease preventing roller 136 has a rigid coaxial solid or hollow core 138, a pair of web spreading portion 140 and 142 concentrically affixed to the core, and a thin elastomeric peripheral covering 144 over the web spreading portions. See FIG. 13. There is no elastic (e.g. rubber) sleeve portion 80 or 112 concentrically affixed to the core as in the preferred and first alternate embodiments.

The donor web guide/crease preventing roller platen roller 136 operates as a crease preventing roller because the web spreading portions 140 and 142 are similarly coiled diagonally about the core 138 and inwardly from opposite coaxial ends 146 and 148 of the roller, to be coiled towards one another from the opposite ends. In this instance, as compared to the preferred and alternate embodiments, the web spreading portions 140 and 142 meet midway between the opposite ends 146 and 148.

The invention has been described in detail with particular reference to certain preferred embodiments thereof, but it will be understood that variations and modifications can be effected within the spirit and scope of the invention.

PARTS LIST

1. donor web
2. cyan color section
3. magenta color section
4. yellow color section
5. dye transfer area
6. longitudinal edge area
7. longitudinal edge area
W. web width
10. thermal dye transfer printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. thermal print head
49A, 49B. resistive elements
50. donor web supply spool
51. donor web guide web bar
52. donor web guide nose
54. donor web take-up spool
55. cartridge
56. diverter
58. exit tray
60. exit roller
61. exit roller
F. pulling force
62. slanted creases or wrinkles
64. regions
α. acute angle
66. trailing or rear end portion
68. leading or front end portion
70. line artifacts
72. leading or front end portion
74. heat activating control
76. platen/crease preventing roller
78. coaxial core
80. sleeve portion
82. web spreading portion
84. web spreading portion
86. peripheral covering
88. width
90. thickness
92. thickness
94. width
96. thickness
98. distance
100. diameter
102. opposite end
104. opposite end
106, 106. web spreading directions
θ. acute angle
108. web guide/crease preventing roller
110. coaxial core
112. sleeve portion
114. web spreading portion
116. web spreading portion
120. peripheral covering
122. width
124. thickness
126. thickness
128. distance
130. diameter
132. opposite end
134. opposite end
136. web guide/crease preventing roller
138. coaxial core
140. web spreading portion
142. web spreading portion
144. peripheral covering
146. opposite end
148. opposite end

What is claimed is:

1. A thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a web take-up that takes up the dye donor web, and that exerts a pulling force on the dye transfer area and two edge areas at said print head which is sufficient to stretch the dye transfer area relative to the two edge areas to possibly form slanted creases diagonally extending at least across respective regions adjacent the two edge areas; and a crease preventing roller having respective web spreading portions that are similarly coiled inwardly along said roller from opposite coaxial ends of said roller, to be coiled towards one another from said opposite ends, in order to diagonally spread at least the web regions in which slanted creases can form, in opposition to crease formation that can occur when the pulling force is exerted on the dye transfer area and two edge areas at said print head, whereby crease formation can at least be substantially prevented, wherein said web spreading portions are similarly coiled inwardly along said roller to support the two edge areas, but not the dye transfer area, to diagonally urge the two edge areas to diagonally spread at least the web regions close to the two edge areas, and said crease preventing roller has an elastic portion between said web spreading portions to support the dye transfer area.

2. A thermal printer as recited in claim 1, wherein said web spreading portions are similarly coiled inwardly along said roller sufficiently to meet midway between said opposite ends in order to support the dye transfer area and two edge areas alongside the dye transfer area, to diagonally urge the dye transfer area and two edge areas to diagonally spread them in opposition to crease formation that can occur.

3. A thermal printer as recited in claim 2, wherein said crease preventing roller is located between said print head and a web supply spool for the dye donor web, but closer to said print head.

4. A thermal printer as recited in claim 2, wherein said crease preventing roller is located between said print head and said web take-up, but closer to said print head.

5. A thermal printer as recited in claim 1, wherein said crease preventing roller is a platen roller adapted to locally support the dye receiver and the dye transfer area and two edge areas alongside the dye transfer area at said print head so that dye transfer can occur from the dye transfer area to the dye receiver.

6. A thermal printer as recited in claim 1, wherein said web spreading portions are diagonally wound fibers that are similarly wound inwardly along said roller from said opposite ends, to be wound towards one another from said opposite ends.

7. A thermal printer as recited in claim 6, wherein said crease spreading roller has a rigid coaxial core, and said fibers are diagonally wound about said core.

8. A thermal printer as recited in claim 7, wherein said fibers are wound at a 45° inclination about said core.

9. A thermal printer capable of preventing crease formation in a dye transfer area of a dye donor web that can cause line artifacts to be printed on a dye receiver during a dye transfer from the dye transfer area to the dye receiver, said printer comprising:

a thermal print head for heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

a web take-up that takes up the dye donor web, and that exerts a pulling force on the dye transfer area and two edge areas at said print head which is sufficient to longitudinally stretch the dye transfer area relative to the two edge areas to possibly form slanted creases diagonally extending at least across respective regions adjacent the two edge areas; and a crease preventing roller having a rigid coaxial core and respective web spreading portions that are similarly coiled diagonally about said core and inwardly from opposite coaxial ends of said roller, to be coiled towards one another from said opposite ends, in order to diagonally spread at least the web regions in which slanted creases can form, to perpendicularly oppose crease formation that can occur when the pulling force is exerted on the dye transfer area and two edge areas at said print head, whereby crease formation can at least be substantially prevented, wherein said web spreading portions are similarly coiled inwardly along said roller to support the two edge areas, but not the dye transfer area, to diagonally urge the two edge areas to diagonally spread at least the web regions close to the two edge areas, and said crease preventing roller has an elastic portion between said web spreading portions to support the dye transfer area.

10. A method of preventing crease formation in a dye transfer area of a dye donor web that can cause line artifacts to be printed on a dye receiver during a dye transfer from the dye transfer area to the dye receiver in a dye transfer printer, said method comprising:

heating the dye transfer area of the dye donor web sufficiently to effect a dye transfer from the dye transfer area to the dye receiver, but not heating two opposite edge areas of the dye donor web alongside the dye transfer area sufficiently to effect a dye transfer from the two edge areas to the dye receiver, so that the dye transfer area is vulnerable to being stretched relative to the two edge areas;

taking up the dye donor web, but exerting a pulling force on the dye transfer area and two edge areas at the print head which is sufficient to stretch the dye transfer area relative to the two edge areas to possibly form slanted creases diagonally extending at least across respective regions adjacent the two edge areas; and rotating a crease preventing roller having respective web spreading portions coiled inwardly along the roller from opposite coaxial ends of the roller, and coiled towards one another;

engaging the dye donor web with an elastomeric cover surrounding at least the web spreading portions of the roller thereby exerting a spreading force at least to the two edge areas thereby reducing crease formation.

11. A thermal printer comprising:

a thermal print head for heating a dye transfer area of a dye donor web sufficiently to effect a dye transfer from the dye transfer area to a dye receiver, but not heating two opposing edge areas of the dye donor web adjacent the dye transfer area sufficiently to effect a dye transfer from the two edge areas to the dye receiver;

a web take-up that takes up the dye donor web, and that exerts a pulling force on the dye transfer area and two edge areas at said print head which is sufficient to stretch the dye transfer area relative to the two edge areas;

a roller having respective generally helical members projecting therefrom that are coiled inwardly along said roller from opposite ends thereof, said respective generally helical members exerting a spreading force on the dye donor web to reduce crease formation; and an elastomeric cover over said respective generally helical members.

12. A thermal printer as recited in claim 11 wherein:

said elastomeric cover is a single contiguous sleeve covering both helical members.

13. A thermal printer as recited in claim 11 wherein:

said roller is a platen roller.

14. A thermal printer as recited in claim 11 wherein:

each of said respective generally helical members is a screw-like member.

15. A thermal printer as recited in claim 11 wherein:

each of said respective generally helical members is a coiled member wrapped about said roller.

* * * * *